US007598937B2

(12) United States Patent
Lin et al.

(10) Patent No.: US 7,598,937 B2
(45) Date of Patent: Oct. 6, 2009

(54) DISPLAY PANEL

(75) Inventors: Che-Li Lin, Taipei (TW); Chang-San Chen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 619 days.

(21) Appl. No.: 11/161,726

(22) Filed: Aug. 15, 2005

(65) Prior Publication Data

US 2006/0284809 A1 Dec. 21, 2006

(30) Foreign Application Priority Data

Jun. 15, 2005 (TW) ..... 94119773 A

(51) Int. Cl.
*G09G 3/36* (2006.01)

(52) U.S. Cl. ..... 345/90

(58) Field of Classification Search ..... None
See application file for complete search history.

(56) References Cited

U.S. PATENT DOCUMENTS 5,253,091 A * 10/1993 Kimura et al. ..... 345/94

* cited by examiner

*Primary Examiner*—Sumati Lefkowitz
*Assistant Examiner*—Tammy Pham
(74) *Attorney, Agent, or Firm*—Jianq Chyun IP Office

(57) ABSTRACT

A display panel is disclosed. The display units with the same position at odd rows and even rows are electrically coupled to different data lines, such that most of the time each of the data lines on the display panel is maintained on a single polarity, respectively. Accordingly, the swing voltage of the data lines on the display panel is reduced when scanning an image, such that the power consumption of the display panel is further reduced in order to achieve the object of saving power.

7 Claims, 7 Drawing Sheets

DISPLAY PANEL

CROSS-REFERENCE TO RELATED APPLICATION

This application claims the priority benefit of Taiwan application serial no. 94119773, filed on Jun. 15, 2005. All disclosure of the Taiwan application is incorporated herein by reference.

BACKGROUND OF THE INVENTION

1. Field of the Invention

The present invention relates to a display apparatus, and more particularly, to a display panel for reducing the polarity inversion frequency of the data lines.

2. Description of the Related Art

In recent years, the image display technology has been significantly improved, and a great amount of the conventional CRT display apparatus has been replaced by the flat panel displays. A typical flat panel display includes TFT-LCD (Thin-Film Transistor Liquid Crystal Display), LTPS (Low Temperature Poly Silicon) LCD and OLED (Organic Light Emitting Diode). Recently, the LTPS LCD and a-Si TFT-LCD have become the mainstream of the flat panel display in the market. Different types of LCDs are commonly used in the electronic apparatus such as a laptop computer (a.k.a. notebook computer), a monitor, an AV device, a TV, and a mobile phone (a.k.a. cellular phone).

Figure 1:
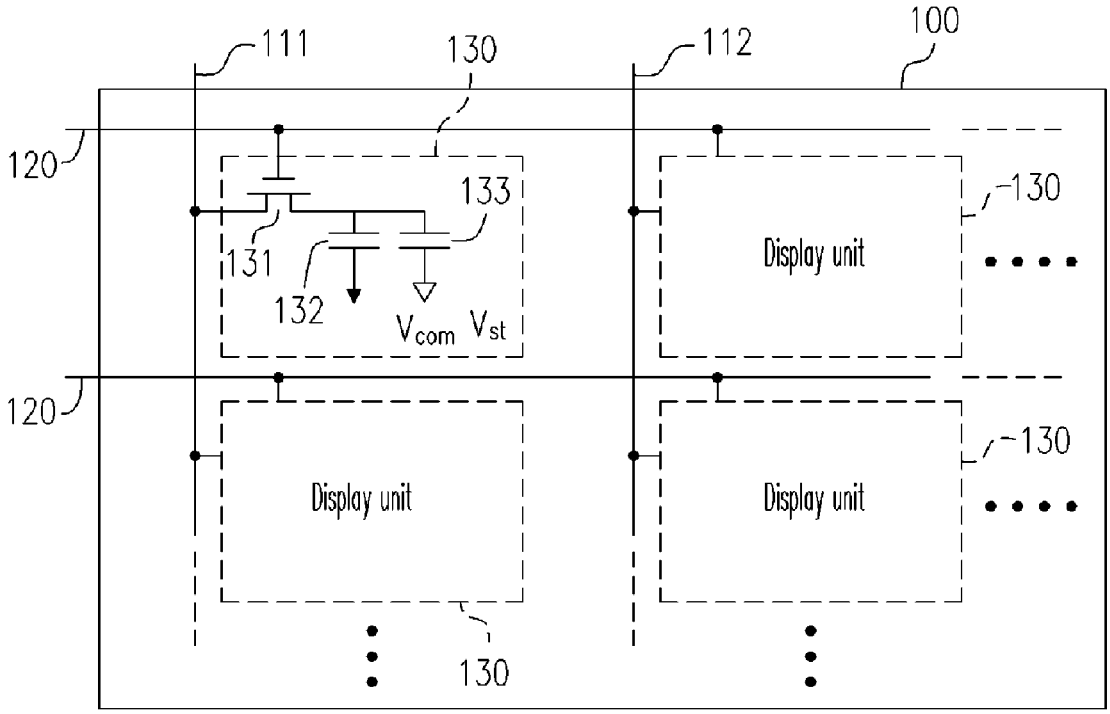
FIG. 1 (PRIOR ART)

FIG. 1 schematically shows a conventional liquid crystal display (LCD) panel. Referring to FIG. 1, the display panel 100 of the panel display apparatus is composed of a display unit array. Wherein, the display unit array is typically an m×n matrix (e.g. the matrix formed by the display units 130 shown in the diagram), and each of the display units 130 is controlled by a plurality of drivers (not shown) via the data lines 111, 112 and the scan lines 120, respectively. In addition, each of the display units 130 comprises a switch 131 (e.g. a Thin-Film Transistor (TFT)), a liquid crystal capacitor 132 and a storage capacitor 133. Wherein, the switch 131 transmits the data of the corresponding data line to the liquid crystal capacitor 132 and the storage capacitor 133 in response to a signal on the corresponding scan line 120. The liquid crystal capacitor 132 and the storage capacitor 133 store the data on the data line 111 in response to a common voltage Vcom and a storage voltage Vst, respectively. The plurality of drivers drive the corresponding display units 130 based on the rasterized pixel data. In response to the control from the drivers, each of the display units 130 displays a desired color at a desired time point.

However, along with the trend of large-size panel and the increase of resolution as well as the fact that higher voltage is required to drive the wide view angle technique such as In-plane Switching (IPS) or Multi-domain Vertically Alignment (MVA), the power consumption on the conventional panel display apparatus has been greatly increased. In the consideration of environmental protection, how to reduce the power consumption of the panel display apparatus has become an important subject.

Figure 2:
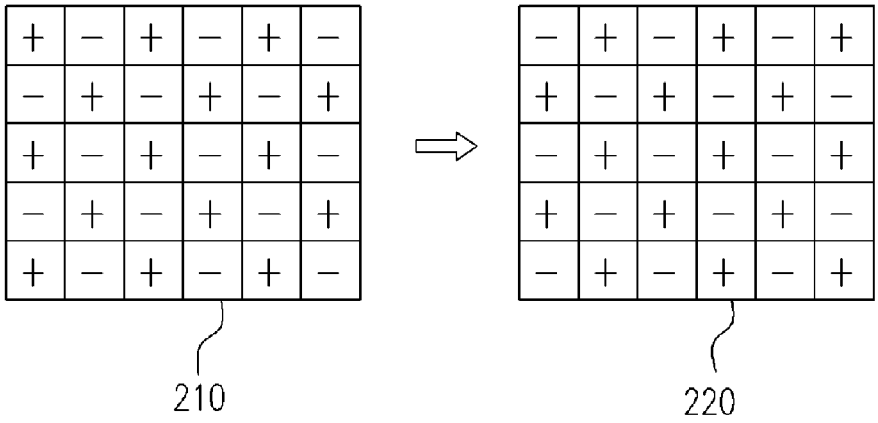
FIG. 2 (PRIOR ART)

In addition, since the liquid crystal is used by the display panel of the TFT-LCD to control the display, in order to avoid the liquid crystal from polarization, the liquid crystal should be driven in an alternating current way. Accordingly, various polarity inversion driving methods such as Line Inversion, Dot Inversion and Column Inversion driving methods have been developed. FIG. 2 schematically shows a diagram illustrating a conventional dot inversion method for driving the display panel. As shown in the diagram, in the $n^{th}$ frame 210, the polarity of the adjacent display units is opposite with each other. When the $(N+1)^{th}$ frame 220 is displayed on the display panel 100, the polarity of each display unit is inversed.

Figure 3:
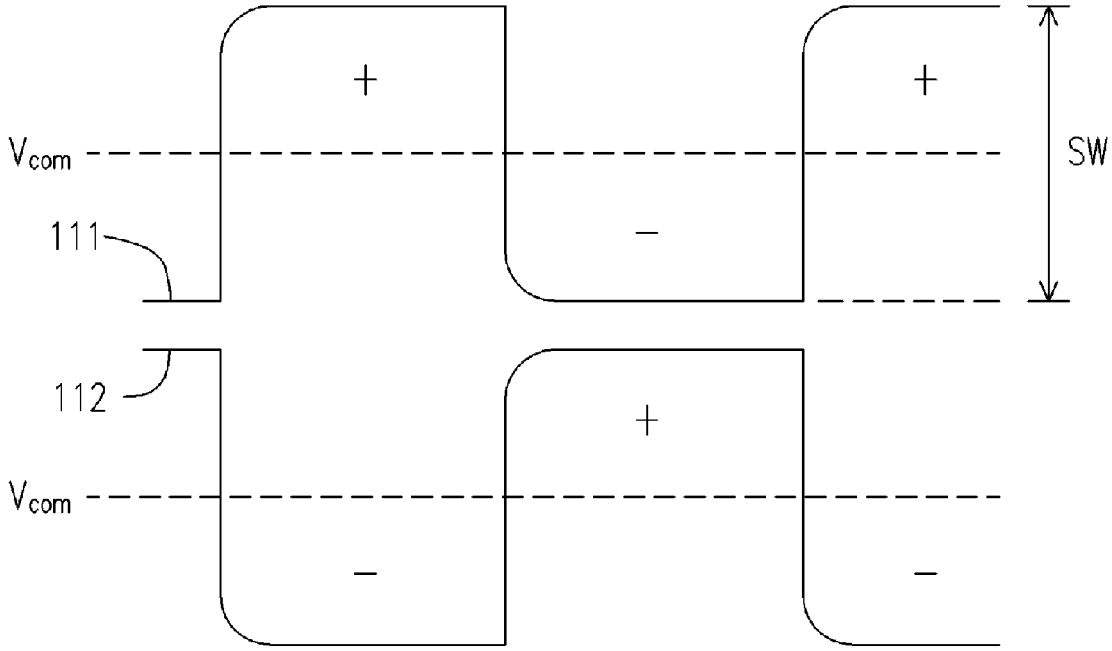
FIG. 3 (PRIOR ART)

FIG. 3 schematically shows a signal timing diagram of the data lines 111 and 112. Since the large-size panel is typically designed to use the DC common voltage Vcom, the data lines 111 and 112 of the display panel 100 have a positive voltage higher than the common voltage Vcom and a negative voltage lower than the common voltage Vcom. Accordingly, the source drivers have to provide a swing voltage SW that is about two times amount of the common voltage Vcom. The power consumption of the display panel will be influenced by the swing voltage SW.

SUMMARY OF THE INVENTION

Therefore, it is an object of the present invention to provide a display panel for reducing the swing voltage on the data lines when scanning an image. Most of the time, each of the data lines on the display panel is maintained on a single polarity, respectively, such that only half amount of the swing voltage is output from the data lines. Accordingly, the power consumption of the display panel is reduced and the object of power saving is achieved.

It is another object of the present invention to provide a display panel for achieving the objects mentioned above and improving the aperture ratio of the display panel.

In order to achieve the object mentioned above and others, the present invention provides a display panel. The display panel comprises X data lines $DL_i$, Y scan lines $SL_j$, and a plurality of display units $SP_{i,j}$. Wherein, X and Y are positive integers; $DL_i$ represents the $j^{th}$ data line; $SL_j$ represents the $j^{th}$ scan line; and $SP_{i,j}$ represents the display unit of the $j^{th}$ column and the $j^{th}$ row. Here, i is an integer greater than or equal to 0 but less than X, and j is an integer greater than or equal to 0 but less than Y. In addition, the display unit $SP_{2s,2t}$ is electrically coupled to the scan line $SL_{2t}$ and the data line $DL_{2s+1}$; the display unit $SP_{2s+1,2t}$ is electrically coupled to the scan line $SL_{2t}$ and the data line $DL_{2s+1}$; the display unit $SP_{2s,2t+1}$ is electrically coupled to the scan line $SL_{2t+1}$ and the data line $DL_{2s+1}$; and the display unit $SP_{2s+1,2t+1}$ is electrically coupled to the scan line $SL_{2t+1}$ and the data line $DL_{2s}$. Wherein, s is an integer greater than or equal to 0 but less than X/2, and t is an integer greater than or equal to 0 but less than Y/2.

In the display panel according to a preferred embodiment of the present invention, the data line $DL_{2s}$ and the data line $DL_{2s+1}$ mentioned above are interleavedly arranged on the display panel.

According to another aspect of the present invention, a display panel is provided by the present invention. The display panel comprises X+1 data lines $DL_i$, Y scanning lines $SL_j$ and a plurality of display units $SP_{n,j}$. Wherein, X and Y are positive integers; $DL_i$ represents the $i^{th}$ data line; $SL_j$ represents the $j^{th}$ scan line; and $SP_{n,j}$ represents the display unit of the $n^{th}$ column and the $j^{th}$ row. Here, i is an integer greater than or equal to 0 but less than X+1, and j is an integer greater than or equal to 0 but less than Y. In addition, the display unit $SP^{n,2t}$ is electrically coupled to the scan line $SL^{2t}$ and the data line $DL_n$; the display unit $SP_{n,2t+1}$ is electrically coupled to the scan line $SL_{2t+1}$ and the data line $DL_{n+1}$; where n is an integer greater than or equal to 0 but less than X, and t is an integer greater than or equal to 0 but less than Y/2.

In the present invention, the display units with the same position at odd rows and even rows are electrically coupled to different data lines, such that most of the time each of the data lines on the display panel is maintained on a single polarity, respectively. Accordingly, the swing voltage of the data lines on the display panel is reduced when scanning an image. As such, the power consumption of the display panel is further reduced so the object of saving power is achieved.

BRIEF DESCRIPTION DRAWINGS

The accompanying drawings are included to provide a further understanding of the invention, and are incorporated in and constitute a part of this specification. The drawings illustrate embodiments of the invention, and together with the description, serve to explain the principles of the invention.

FIG. 1 schematically shows a conventional LCD display panel.

FIG. 2 schematically shows a diagram illustrating a conventional dot inversion method for driving the display panel.

FIG. 3 schematically shows a signal timing diagram of the data lines of FIG. 1.

Figure 4:
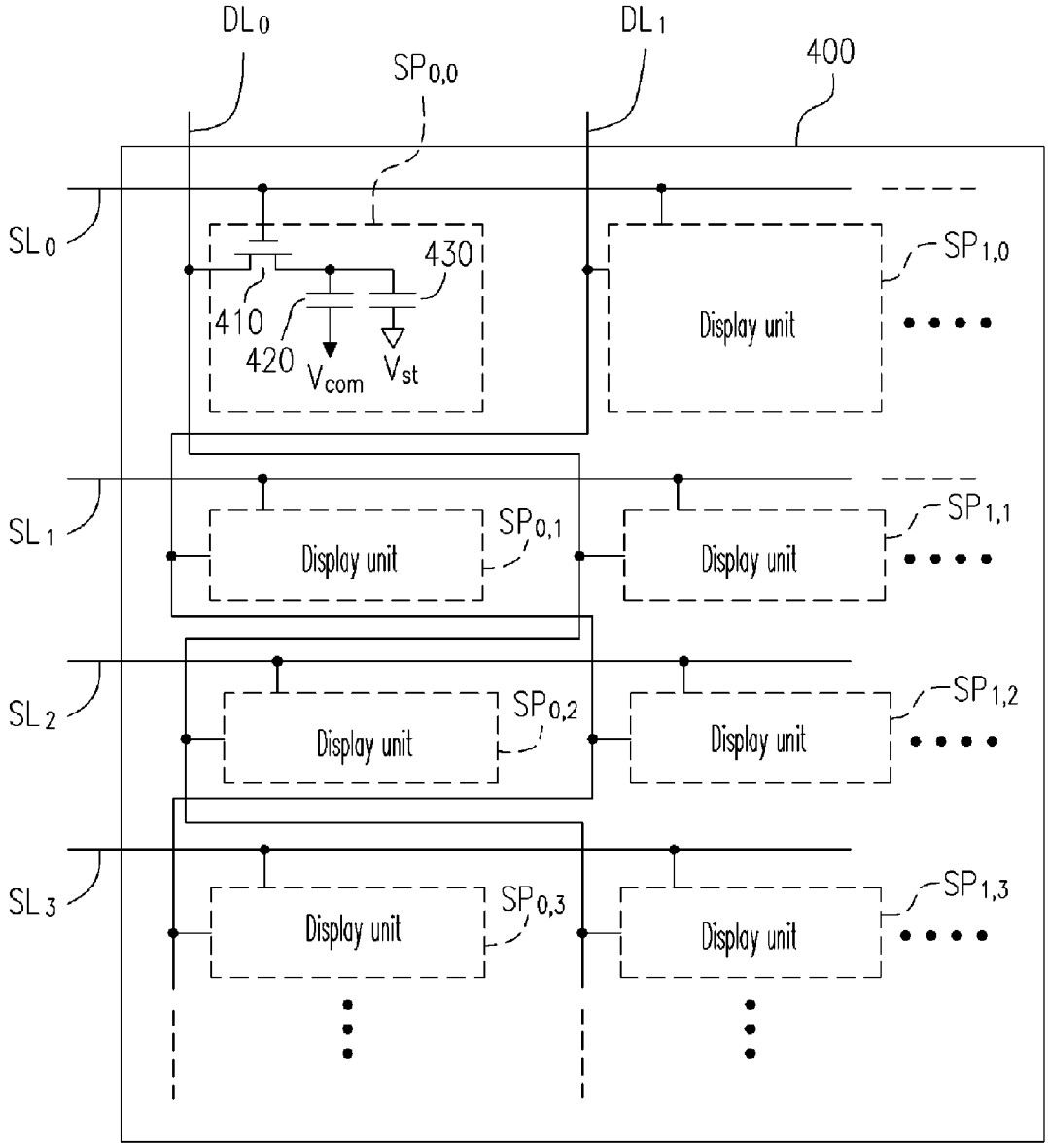

FIG. 4 schematically shows a display panel according to a preferred embodiment of the present invention.

Figure 5:
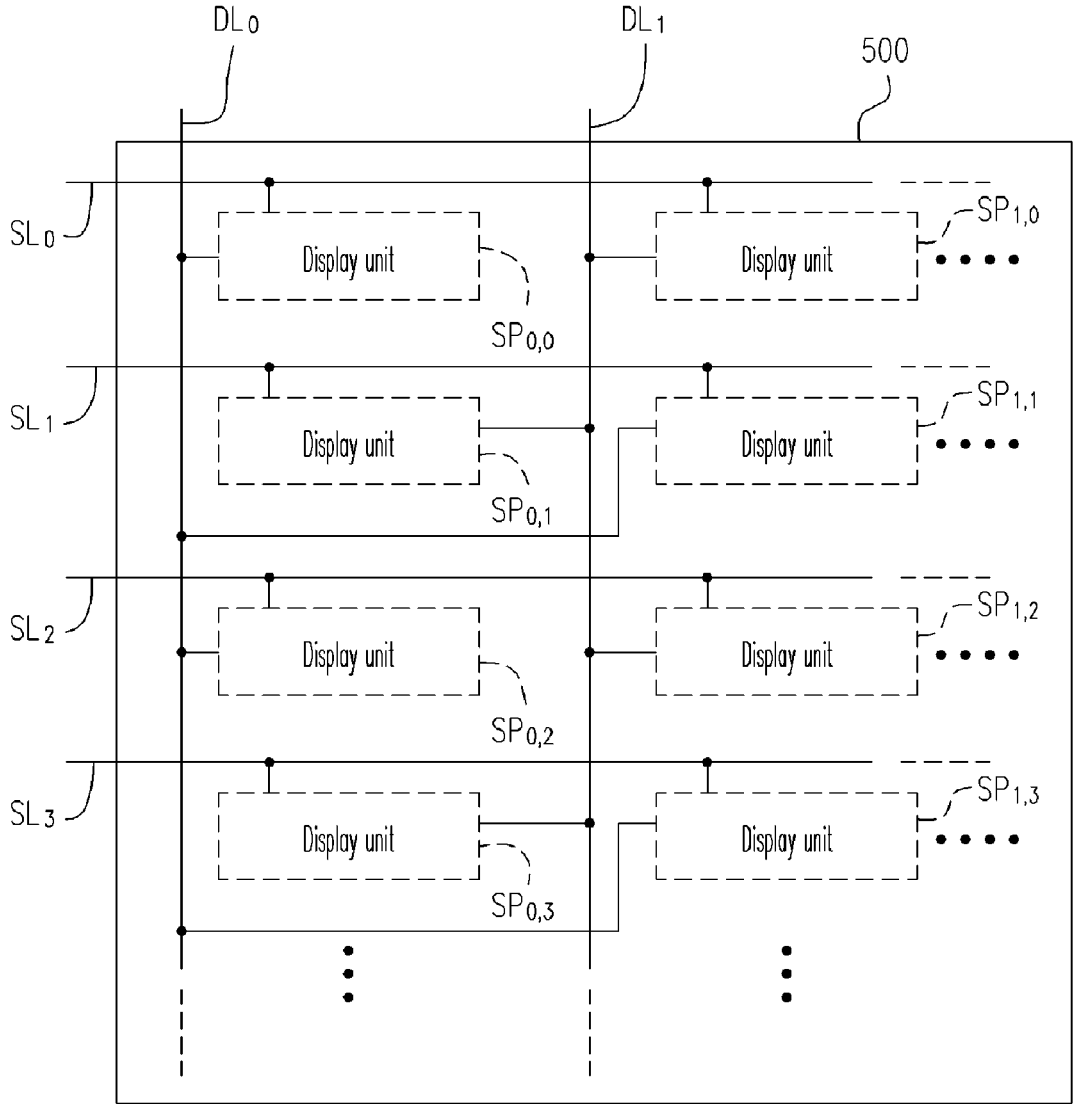

FIG. 5 schematically shows a display panel according to another preferred embodiment of the present invention.

Figure 6:
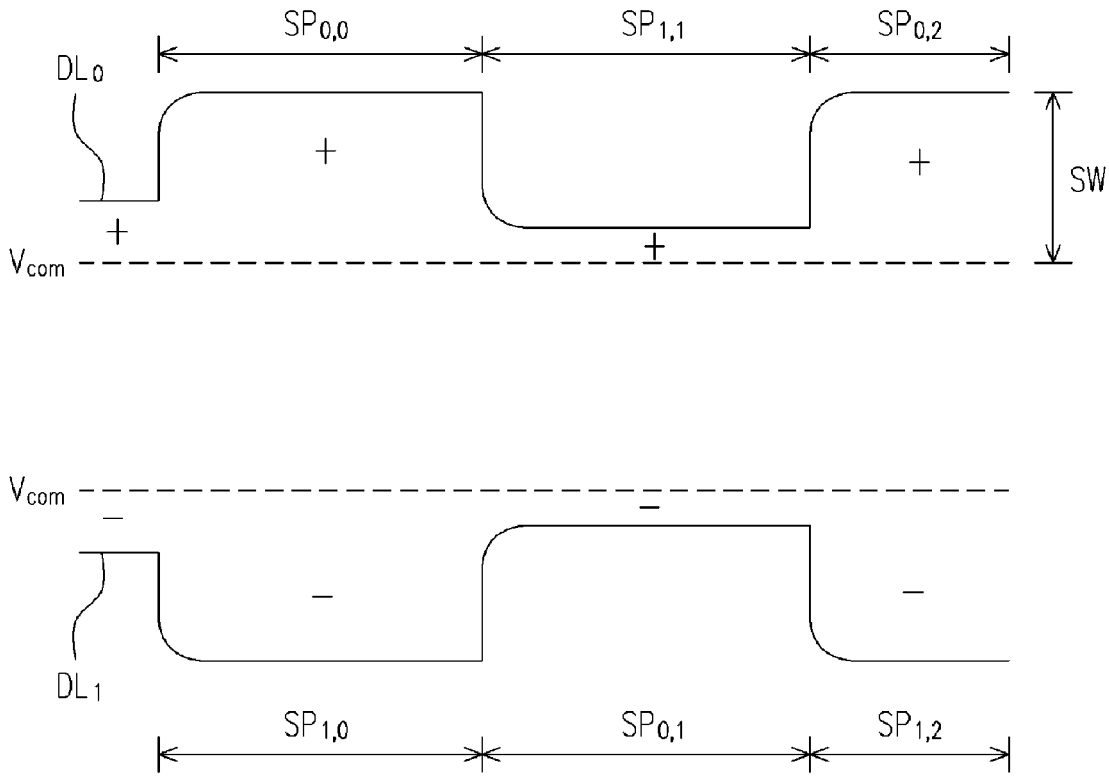

FIG. 6 schematically shows a signal timing diagram of the data lines according to a preferred embodiment of the present invention.

Figure 7:
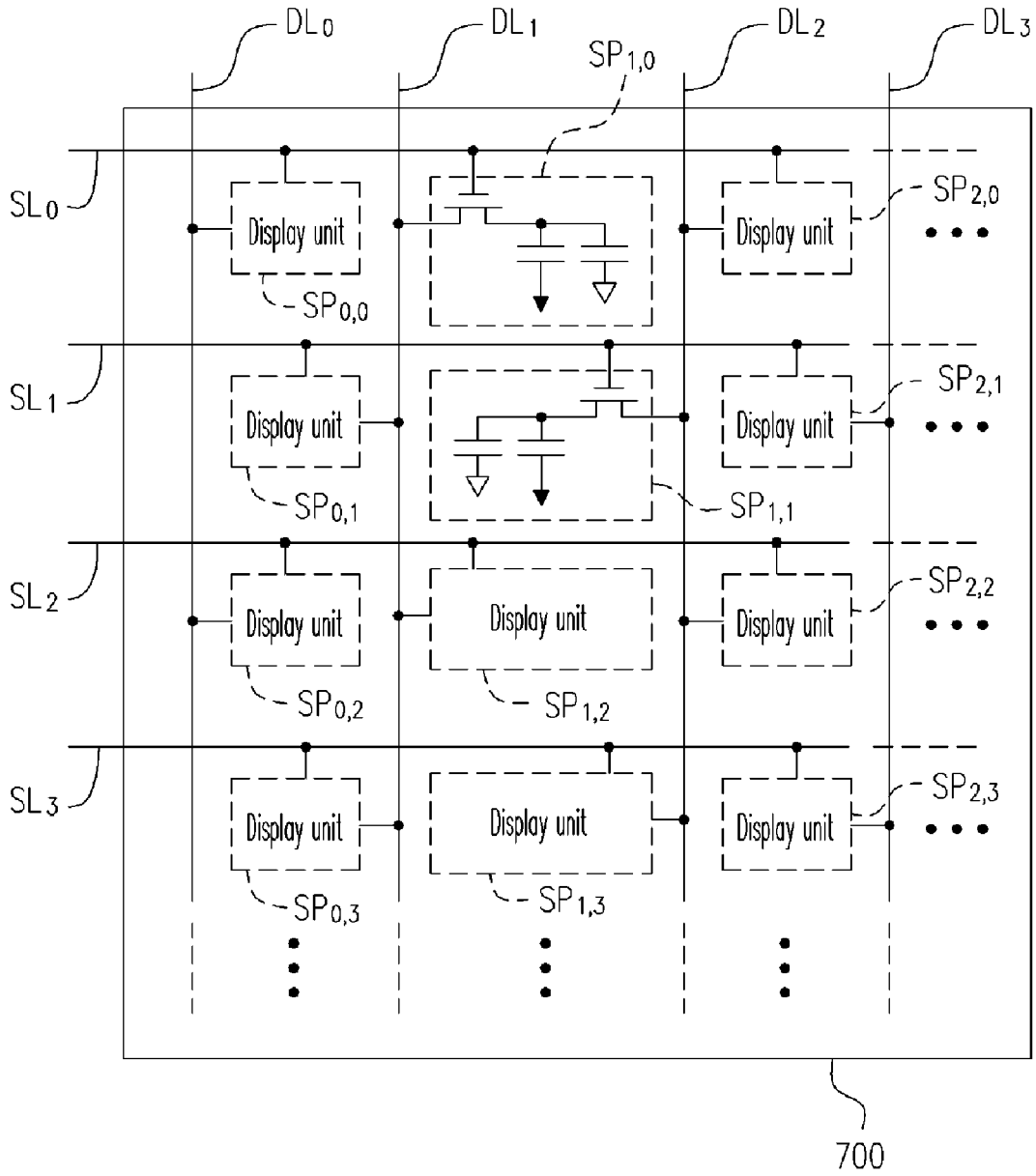

FIG. 7 schematically shows a display panel according to yet another preferred embodiment of the present invention.

Figure 8:
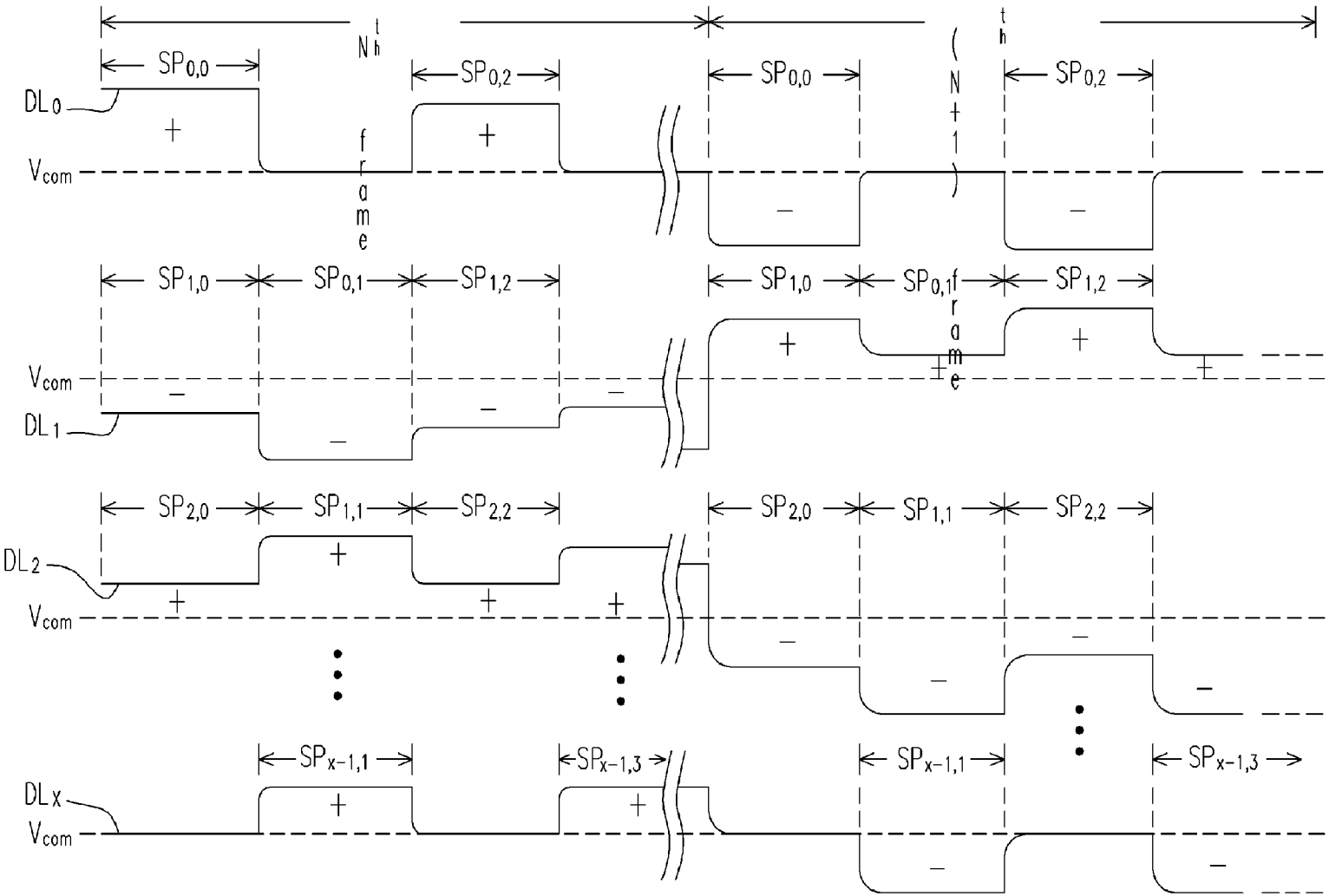

FIG. 8 schematically shows a signal timing diagram of the data lines in FIG. 7.

DESCRIPTION PREFERRED EMBODIMENTS

The LCD display panel is exemplified hereinafter for describing the present invention in greater detail. However, other types of display panels should be easily inferred by one of the ordinary skill in the art based on the spirit of the present invention and the description of the following embodiments. FIG. 4 schematically shows a display panel according to a preferred embodiment of the present invention. Referring to FIG. 4, for describing the present embodiment in greater detail, the peripheral circuit (e.g. the source drivers and the gate drivers) electrically coupled to the display panel 400 is not shown in the diagram. It is assumed that the display panel 400 has X data lines $DL_0$~$DL_{X-1}$, Y scan lines $SL_0$~$SL_{Y-1}$, and X*Y display units $SP_{0,0}$~$SP_{X-1,Y-1}$, where $SP_{i,j}$ represents the display unit of the $i^{th}$ column and the $j^{th}$ row. The gate drivers turn on the corresponding display units via the scan lines $SL_0$~$SL_Y$ in a manner of line by line. In response to a timing of the gate driver, the source drivers transmit the display data to the corresponding display units via the data lines $DL_0$~$DL_X$.

The display unit SP0,0 is exemplified for describing the embodiment of each of the display units hereinafter. The display unit $SP_{0,0}$ comprises a switch 410, a liquid crystal capacitor 420 and a storage capacitor 430. The switch may be a Thin-Film Transistor (TFT). A first terminal of the switch 410 is electrically coupled to the corresponding scan line (i.e. the scan line $SL_0$), a second terminal is electrically coupled to the corresponding data line (i.e. the data line $DL_0$), and a third terminal is electrically coupled to the liquid crystal capacitor 420 and the storage capacitor 430. Wherein, whether the second terminal and the third terminal are electrically coupled or not is determined by the switch 410 in response to the control from the first terminal. In other words, the switch 410 transmits the data on the data line DL0 to the liquid crystal capacitor 420 and the storage capacitor 430 in response to the control timing of the scan line $SL_0$. The liquid crystal capacitor 420 and the storage capacitor 430 store the data of the data line $DL_0$ in response to the common voltage Vcom and the storage voltage Vst.

In the present embodiment, the adjacent even data lines $DL_{2s}$ and the odd data lines $DL_{2s+1}$ (where s is an integer greater than or equal to 0 but less than X/2) are interleavedly arranged on the display panel 400. As shown in FIG. 4, the data lines DL0 and DL1 are interleavedly arranged on the display panel 400. Therefore, $SP_{2s,2t}$ is electrically coupled to $SL_{2t}$ and $DL_{2s}$; $SP_{2s+1,2t}$ is electrically coupled to $SL_{2t}$ and $DL_{2s+1}$; $SP_{2s,2t+1}$ is electrically coupled to $SL_{2t+1}$ and $DL_{2s+1}$; and $SP_{2s+1,2t+1}$ is electrically coupled to $SL_{2t+1}$ and $DL_{2s}$. Wherein, t is an integer greater than or equal to 0 but less than Y/2 as shown in the diagram.

The even data lines $DL_{2s}$ and the odd data lines $DL_{2s+1}$ may be arranged by one of the ordinary skill in the art in different way. For example, the data lines may be arranged in a layout of straight lines. FIG. 5 schematically shows a layout diagram of the adjacent even data lines $DL_{2s}$ and the odd data lines $DL_{2s+1}$ on the display panel 500 according to a preferred embodiment of the present invention.

FIG. 6 schematically shows a signal timing diagram of the data lines $DL_0$ and $DL_1$ according to a preferred embodiment of the present invention. As shown in FIG. 6, most of the time, each of the data lines on the display panel 400 (or the display panel 500) is maintained on a single polarity, respectively. Accordingly, the swing voltage SW of the data line on the display panel is reduced when scanning an image (it is reduced to about 50% compared with the conventional technique), such that the power consumption of the display panel is further reduced for achieving the object of saving power.

Although the adjacent even data lines $DL_2$, (e.g. $DL_0$) and the odd data lines $DL_{2s+1}$ (e.g. $DL_1$) on the display panel 400 (or the display panel 500) in FIG. 6 are maintained on the positive polarity and the negative polarity, respectively. The polarity of the data lines may be inversed by the one of the ordinary skill in the art at the appropriate time point based on the real requirement. For example, after a full frame data has been transmitted by each of the data lines, the polarity of the even data lines $DL_{2s}$ (e.g. $DL_0$) is switched from positive to negative, and the polarity of the odd data lines $DL_{2s+1}$ (e.g. $DL_1$) is switched from negative to positive, and others can be deduced by applying the same. Alternatively, the polarity of the even data line $DL_{2S}$ (e.g. $DL_0$) and the polarity of the odd data line $DL_{2S+1}$ (e.g. DL1) are exchanged after the accumulated time amount has reached a randomly determined time.

In order to increase the aperture ratio of the display panel, another embodiment of the present invention is described with referring to FIG. 7 hereinafter. The display panel 700 may be an LCD display panel. The display panel 700 has X+1 data lines $DL_0$~$DL_X$, Y scan lines $SL_0$~$SL_{Y-1}$ and X*Y display units $SP_{0,0}$~$SP_{X-1,Y-1}$. Wherein, $DL_i$ represents the $i^{th}$ data line, $SL_j$ represents the $j^{th}$ scan line, and $SP_{n,j}$ represents the display unit of the $n^{th}$ column and the $j^{th}$ row. Here, i is an integer greater than or equal to 0 but less than X+1, j is an integer greater than or equal to 0 but less than Y, and n is an integer greater than or equal to 0 but less than X. In addition, the display unit $SP_{n,2t}$ is electrically coupled to the scan line $SL_{2t}$ and the data line $DL_n$; and the display unit $SP_{n,2t+1}$ is electrically coupled to the scan line $SL_{2t+1}$ and the data line $DL_{n+1}$, where t is an integer greater than or equal to 0 but less than Y/2.

Each of the display units $SP_{0,0}$~$SP_{X-1,Y-1}$ in FIG. 7 may be implemented with referring to the display unit $SP_{0,0}$ in FIG. 4 or with other conventional technique, and its detailed description is omitted herein. FIG. 8 schematically shows a signal timing diagram of the data lines $DL_0$~$DL_X$. Referring to FIG.

7 and FIG. 8, although it is assumed that the column number X of the display unit array is an even number herein, other number can be easily inferred by the one of the ordinary skill in the art based on the principle of the present embodiment. Comparing with the previous embodiment, one more data line is required in the present embodiment. In the present embodiment, the display units with the same position at odd rows and even rows (e.g. the display units $SP_{1,0}$ and $SP_{1,1}$) in the display panel 700 are electrically coupled to different data lines respectively, such that most of the time each of the data lines $DL_0$~$DL_X$ on the display panel is maintained on a single polarity. Accordingly, the swing voltage of the data lines on the display panel is reduced when scanning an image, such that the power consumption of the display panel is further reduced in order to achieve the object of saving power.

In the present embodiment, it is assumed that the polarity of the even data line $DL_{2S}$ (e.g. $DL_0$) and the polarity of the odd data line $DL_{2S+1}$ (e.g. DL1) are switched over after a full frame data has been transmitted by each of the data lines. Therefore, each of the data lines $DL_0$~$DL_X$ on the display panel 700 is maintained on a single polarity during the same period of frame, respectively, such that the dot inversion driving effect as shown in FIG. 2 is achieved. The polarity of each data line may be inversed by the one of the ordinary skill in the art at any appropriate time point based on the real requirement. For example, the polarity of the even data line $DL_{2S}$ (e.g. DL0) and the polarity of the odd data line $DL_{2S+1}$ (e.g. DL1) may be inversed after the accumulated time amount has reached a randomly determined time.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A display panel, comprising:

Y scan lines $SL_j$, wherein $SL_j$ represents the jth scan line, j is an integer greater than or equal to 0 but less than Y and Y is a positive integer;

X data lines $DL_i$, wherein $DL_i$represents the ith data line, i is an integer greater than or equal to 0 but less than X, and X is a positive integer; and a plurality of display units $SP_{ij}$, wherein $SP_{ij}$, represents the display unit of the ith column and the jth row, the display unit $SP_{2s,2t}$ is directly connected to the scan line $SL_{2t}$ and the data line $DL_{2s}$;the display unit $SP_{2s+1,2t}$ is directly connected to the scan line $SL_2$and the data line $DL_{2s+1}$; the display unit $SP_{2s,2t+1}$ is directly connected to the scan line $SL_{2t+1}$; and the data line $DL_{2s+1}$; and the display unit $SP_{2s+1,2t+1}$ is directly connected to the scan line $SL_{2t+1}$ and the data line $DL_{2s}$, where s is an integer greater than or equal to 0 but less than X/2, and t is an integer greater than or equal to 0 but less than Y/2.

2. The display panel of claim 1, wherein the data line DL2s and the data line DL2s+1are interleavedly arranged on the display panel.

3. The display panel of claim 1, wherein each of the display units comprises:

a switch having a first terminal, a second terminal and a third terminal for determining whether the second terminal is electrically coupled to the third terminal in response to a control from the first terminal, wherein the first terminal electrically coupled to a corresponding scan line, and the second terminal electrically coupled to a corresponding data line; and a liquid crystal capacitor electrically coupled between the third terminal of the switch and a common voltage line.

4. The display panel of claim 3, wherein each of the display units further comprises a storage capacitor electrically coupled between the third terminal of the switch and a storage voltage line.

5. The display panel of claim 3, wherein the switch is a Thin-Film Transistor (TFT).

6. The display panel of claim 1, wherein the display panel is an LCD display panel.

7. The display panel of claim 1, wherein the polarity of the data line $DL_{2s}$ and the polarity of the data lien $DL_{2s+1}$are opposite with each other, and s is an integer greater than or equal to 0 but less than X/2.

* * * * *